United States Patent [19]

Landry

[11] 4,338,609

[45] Jul. 6, 1982

[54] SHORT HORN RADIATOR ASSEMBLY

[75] Inventor: Norman R. Landry, Mount Laurel, N.J.

[73] Assignee: RCA Corporation, New York, N.Y.

[21] Appl. No.: 216,168

[22] Filed: Dec. 15, 1980

[51] Int. Cl.[3] ..... H01Q 13/00

[52] U.S. Cl. ..... 343/786; 343/787; 343/772

[58] Field of Search ..... 343/851, 862, 772–780, 343/786–787, 907

[56] References Cited

U.S. PATENT DOCUMENTS

| | | | |
|---|---|---|---|
| 2,905,940 | 9/1959 | Spencer et al. | 343/778 |
| 2,906,974 | 9/1959 | Reggia et al. | 333/98 |
| 2,994,084 | 7/1961 | Miller | 343/783 |
| 3,268,902 | 8/1966 | Turrin | 343/772 |
| 3,435,383 | 3/1969 | Reggia | 343/786 |
| 3,475,757 | 10/1969 | Parris | 343/786 |
| 3,555,460 | 1/1971 | Landry | 333/24.1 |
| 3,605,101 | 9/1971 | Kolettis | 343/783 |
| 3,611,392 | 10/1971 | Knox | 343/755 |
| 3,698,000 | 10/1972 | Landry et al. | 343/772 |
| 3,760,305 | 9/1973 | Mason et al. | 333/95 R |
| 3,761,938 | 9/1973 | Reggia | 343/785 |
| 3,768,040 | 10/1973 | Mason et al. | 333/24.1 |
| 3,849,746 | 11/1974 | Mason et al. | 333/24.1 |
| 3,854,141 | 12/1974 | Smith | 343/777 |
| 4,138,683 | 2/1979 | Patton et al. | 343/783 |

OTHER PUBLICATIONS

Ince et al., "Nonreciprocal Remanance Phase Shifters in Rectangular Waveguides", IEEE Trans. on Microwave Theory & Techniques, vol. 15 #2, 2/67 pp. 87–95.

Campbell et al., "Broad—Band Wide—Angle Scan Matching Technique for Large Environmentally Restricted Phased Arrays", IEEE Transactions or Antennas and Propagation, vol. AP—20, 7/72, pp. 421–427.

*Primary Examiner*—David K. Moore

*Attorney, Agent, or Firm*—Samuel Cohen; Robert L. Troike; Robert Ochis

[57] ABSTRACT

Substantial weight reduction and size reduction in phased array radiators are obtained by coupling a dielectrically loaded waveguide directly to a short horn radiator whose electrical length is less than one half wavelength at an operating frequency. Coupling is obtained by positioning the waveguide with its end in the interior of the short horn radiator and by causing the dielectric material of the waveguide to protrude beyond the end of the waveguide and to terminate inside the horn.

13 Claims, 2 Drawing Figures

SHORT HORN RADIATOR ASSEMBLY

This invention relates to horn radiators and, more particularly, to the field of horn radiators fed by waveguides.

Gyromagnetic waveguide phase shifters are defined as waveguide phase shifters which utilize the magnetic hysteresis properties of a gyromagnetic material to control the phase shift introduced into a wave propagating in the waveguide. Gyromagnetic material is a general term intended to encompass ferrimagnetic materials, ferromagnetic materials and any other materials which exhibit magnetic hysteresis. Ferrites and garnets of the types commonly used in waveguide phase shifters are specific classes of gyromagnetic materials.

The theory and operation of phase shifters of this general type are well known and are described in an article entitled, "Nonreciprocal Remanence Phase Shifters in Rectangular Waveguide" by Ince and Stern, *IEEE Transactions on Microwave Theory and Techniques,* Vol. MTT-15, No. 2, February 1967, pp 87–95. Particular design details for such phase shifters are discussed in U.S. Pat. Nos. 3,760,305 and 3,768,040 to Mason et al., 3,698,000 to Landry et al. and 3,555,460 to Landry. In many phased array antennas, gyromagnetic phase shifters feed the radiating horns. In the prior art a section of the horn may be considered a transition section of waveguide which is used to couple the gyromagnetic waveguide phase shifter to a long radiating horn. A long horn is one which has an electrical length of more than one half wavelength at an operating frequency of the antenna. The transition waveguide section is matched to the phase shifter at one end and to the radiating horn at the other end. Such coupling techniques allow the radiating portion of the horn and the phase shifter assembly to be designed independently. A coupling section is added to the phase shifter to couple to the otherwise empty transition section of the horn. The horn is designed to properly couple to the external propagation medium into which propagating signals are intended to radiate (or from which they are received). Unfortunately, such independent design results in substantial space and weight being dedicated to coupling the phase shifter to the propagation medium. This is especially true when a rugged, shock-resistant structure is required.

In a phased array antenna, as the number of radiators, each of which has a phase shifter coupled to it, is increased, the weight per radiator becomes a critical factor in overall system cost and weight. A reduced-weight, reduced-size technique for coupling a gyromagnetic waveguide phase shifter to a radiating horn in an array is needed.

In accordance with one embodiment of the present invention a substantial reduction in size and weight of a phased array antenna is achieved by directly coupling one end of a dielectrically loaded waveguide to the interior of a short horn radiator without an intermediate transition waveguide section where the short horn radiator is less than one half of an operating frequency wavelength long. The body of dielectric material protrudes beyond the end of the waveguide and into the interior of the short horn radiator. The dielectric material abruptly terminates within the horn a predetermined distance from the radiating aperture of the horn. The dielectric loaded waveguide may be a gyromagnetic waveguide phase shifter.

Figure 1:
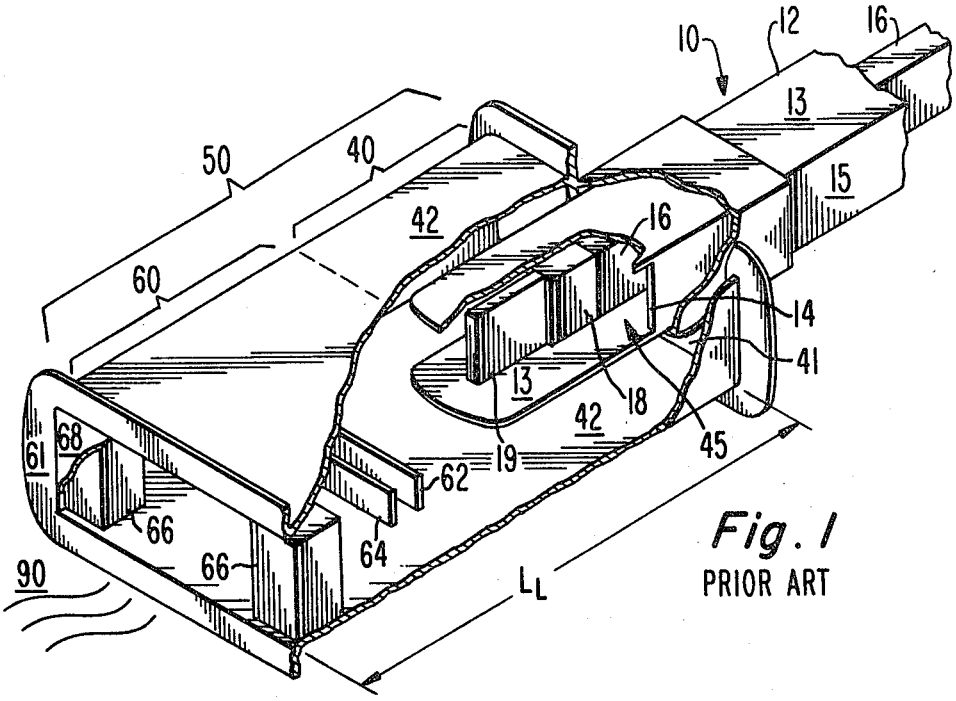
Fig. 1 PRIOR ART
FIG. 1 is a partially broken away, perspective view of a prior art gyromagnetic waveguide phase shifter, coupled to a long horn radiator.

In the prior art structure of FIG. 1, a gyromagnetic waveguide phase shifter 10 is coupled to a long horn 50 including a transition waveguide section 40 and a radiator section 60. A long horn radiator is one which is more than one half operating frequency wavelength long. A coupling section added to the phase shifter protrudes into the otherwise empty transition section 40. The coupling section includes an extension of the broad walls 13 of the phase shifter waveguide 12 and successive transformer stages 18 and 19. The transition waveguide section 40 connects to the radiating portion 60 of horn 50. Radiating portion 60 includes several reactive elements for impedance matching. See, for example, U.S. Pat. No. 3,698,000 of Landry et al. and the article entitled, "A Broad-Band Wide-Angle Scan Matching Technique for Large Environmentally Restricted Phased Arrays," by James J. Campbell and Borislav V. Popovich, *IEEE Transactions on Antennas and Propagation,* Vol. AP-20, No. 4, July 1972, pages 421–427. Each of the articles and patents mentioned is incorporated herein by reference.

For a system designed for operation in the 3.1 to 3.5 GHz band, the horn 50 cross-sectional dimensions are about 2.50 inches (6.35 cm) wide by 0.66 inch (1.67 cm) high by about 6 inches (15.24 cm) long, as shown in FIG. 1. In this horn 50 a frequency of 3.3 GHz has a wavelength of about 5.12 inches (13.00 cm). Thus, the horn 50 as shown in FIG. 1 is about 0.49 wavelength wide by about 0.13 wavelength high by 1.17 wavelengths long.

The gyromagnetic phase shifter 10 includes a waveguide 12, a body 16 of gyromagnetic material extending longitudinally within the waveguide 12 and means for changing the magnetization of the gyromagnetic material. Different magnetizations of the gyromagnetic material cause the phase shifter to have different electrical lengths for a wave of a given frequency propagating down the waveguide 12. This induces different relative phases in the signal emerging from the phase shifter. In the phase shifters of this type which are discussed in the above-mentioned patents, the gyromagnetic material is in the form of a rectangular toroid which has latch wires (not shown in FIG. 1) and a ceramic filler (not shown in FIG. 1) running longitudinally inside the hollow of the toroid. The gyromagnetic material can be in the form of parallel slabs and produce the desired phase changes, as discussed in the cited article. However, the toroidal configuration simplifies the changing of the magnetization of gyromagnetic material. Because the body 16 of the gyromagnetic material is toroidal, a latch current pulse on a latch wire will set the magnetization of gyromagnetic material to a value which depends on the magnitude and duration of the latch current. Thus, the phase shift induced by the phase shifter is externally controllable.

The gyromagnetic toroid 16 of the phase shifter 10 has a dielectric constant of about 15 and encases a body of ceramic material (not shown) which has a dielectric constant of about 50. The broadwalls 13 of the phase shifter waveguide 12 are extended beyond the end of the gyromagnetic insert 16 and into the transition section 40 of the horn in order to match the phase shifter 10 to the horn 50. A dielectric impedance transformer system is added between these broad wall extensions. In the specific embodiment illustrated, the broad walls are extended about 1.50 inches (3.81 cm) or about 0.29 wavelength in the horn 50 (at an operating frequency).

The narrow walls 15 of the phase shifter waveguide 12 are omitted along the dielectric transformer system to facilitate the desired smooth transition in waveguide loading from phase shifter waveguide 12 to the larger, otherwise empty transition waveguide section 40. The narrow walls 15 of phase shifter waveguide 12 extend slightly beyond the back wall 41 of horn 50 and into the interior of the transition section 40 to define the location of a phase shifter waveguide port 45 of the horn 50. The waveguide port 45 is the location where a wave propagating in the shifter waveguide 12 begins to spread out into the larger interior of transition waveguide section 40. The toroid 16 directly contacts a first body 18 of dielectric material to form a first section of the transformer system. The body 18 has a dielectric constant of about 13 and may be formed of magnesium titanate. The first body 18 directly contacts a second body 19 of dielectric material to form a second section of the transformer system. The body of material 19 has a dielectric constant of about 2.3 and may be a teflon/fiberglass laminate. Direct electrical contact between the broad walls 13 of the phase shifter waveguide 12 and the broad walls 42 of the larger, transition waveguide section 40 is assured by elongated spring contacts which are shown and described in U.S. Pat. No. 3,698,000. Two thin capacitive irises 62 and 64 and a thick inductive iris 66 are positioned within the horn 50 to further match the system as discussed in the Campbell et al. article. The overall length ($L_L$) of the long horn 50 including the transition waveguide section 40, measured from the end of the narrow walls 15 of phase shifter waveguide 12 to the front face 61 of the horn is about 6 inches (15.24 cm) or about 1.17 waveguided wavelengths within the horn 50 at a frequency of about 3.3 GHz. The phase shifter 10 and horn 50 when combined have an overall length of about 13.5 inches (34.3 cm) for a relative phase control range of 0°–500° in 5.6° increments. The length of radiating portion 60 of the horn is about 4.5 inches (11.43 cm) or 0.88 wavelength long.

A dielectric window 68 covers the front of the horn 50 and provides environmental protection. This window may preferably be alumina or beryllia. The entire array face may have a further overcoat of dielectric protective material such as RTV (Room Temperature Vulcanizing rubber) if desired. These coupling or matching techniques have been successful in, and have been considered necessary for, coupling the phase shifter 10 to the propagation medium 90 external to the radiator without introducing the large reflections and high Voltage Standing Wave Ratios (VSWR's) which are normally associated with waveguide discontinuities.

The present invention deviates from the prior art by coupling the output end of the gyromagnetic waveguide phase shifter directly to a short horn radiator. This structure exhibits an acceptable VSWR in a phased array antenna.

Figure 2:
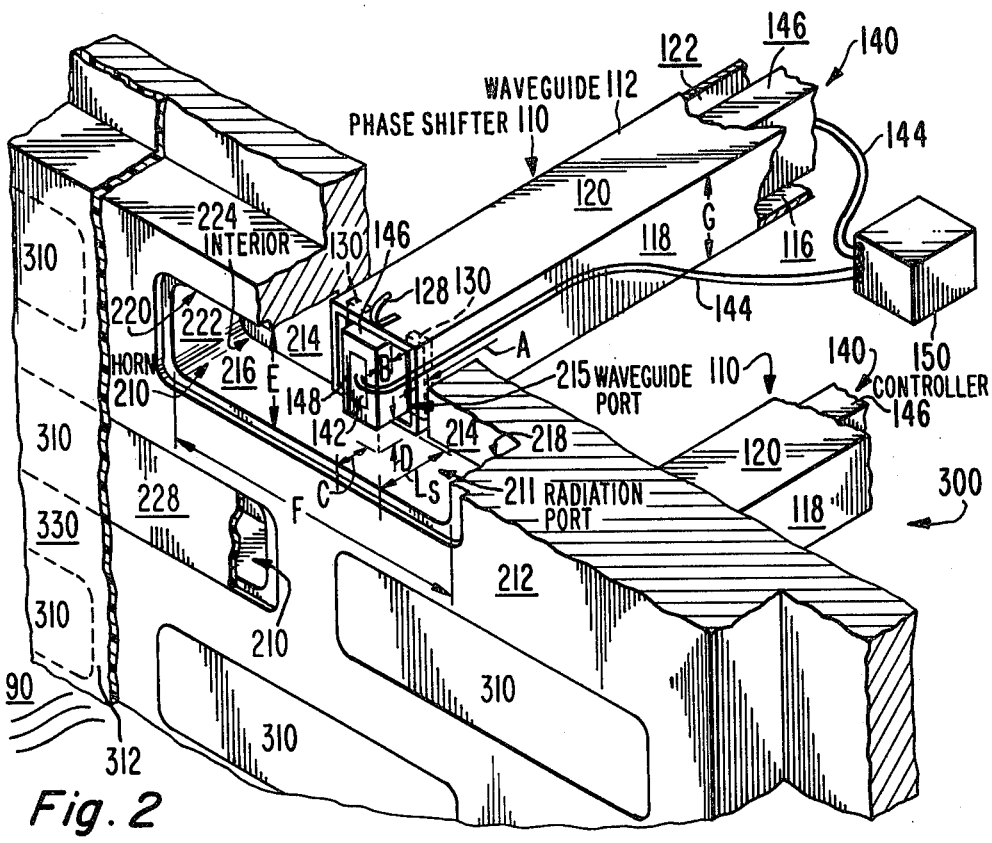
FIG. 2 is a perspective, partially broken away view of a gyromagnetic waveguide phase shifter directly coupled to a short horn radiator in accordance with one embodiment of the present invention.

A phased array antenna in accordance with the invention is illustrated generally at 300 in FIG. 2. The antenna has a front face 312 which has a plurality of radiating apertures 310 arranged therein in a predetermined pattern. The apertures in this embodiment are arranged in a plurality of uniformly spaced horizontal rows. The apertures are uniformly spaced within each row. In every other row the apertures are vertically aligned and the apertures in vertically adjacent rows are offset horizontally by half of the center-to-center (within a given row) aperture spacing.

Each radiating aperture 310 has associated therewith a short horn radiator 210 and a waveguide phase shifter 110, both of which operate in a $TE_{10}$ mode. A portion of the array structure is broken away to illustrate the horn structure and the phase shifter-to-horn coupling.

In this preferred embodiment the short horn 210 has a pair of parallel broad walls 216 and 220, a pair of parallel narrow walls 218 and 222 oriented perpendicular to the broad walls, a physical back wall 214 and a front face 212 parallel to the array face 312 and spaced therefrom by an environmental protection layer 330. If the layer 330 is omitted, the array face 312 is coincident with the horn face 212. The physical interior 224 of horn 210 extends from the front face 212 the full length of the longitudinal walls 216, 218, 220 and 222. Although the horn's opposite walls are preferably parallel, they need not be. The back wall 214 may be omitted, if desired.

For purposes of this specification, a short horn radiator is defined as one which supports substantial higher order mode interaction between its waveguide port 215 where the phase shifter waveguide terminates and its radiation port or radiating aperture 211 at the front face 212. This requires that the separation between these two ports (the effective length ($L_S$) of the short horn) be less than one half-wavelength at an operating frequency. A horn length of less than $\frac{1}{4}$ wavelength is preferred. In the specific example of the preferred embodiment, the horn length is about $\frac{1}{8}$ wavelength at the center of the designed operating band. As is well known, the amount of higher order mode interaction increases as the horn is made shorter. In the prior art long horn systems, there are substantially no higher order mode interactions because the horn is long enough (more than one half wavelength and normally more than one wavelength) that higher order modes have substantially decayed.

Phase shifter 110 comprises a waveguide 112, a loading insert 140 and a control system 150. The waveguide 112 has a pair of parallel broad walls 116 and 120 and an orthogonal pair of parallel narrow walls 118 and 122. The loading insert 140 includes a body 146 of dielectric gyromagnetic material which has low losses at the designed operating frequency. Body 146 is preferably toroidal to simplify the task of changing the remanence of the gyromagnetic material. The body 146 is made tall enough that it is a tight fit between the waveguide broad walls 116 and 120. This assures that the body 146 will contact both of these walls along its surfaces adjacent to these walls.

Latch or drive wires 144 run lengthwise through the center of toroid 146. Ceramic inserts 142 substantially fill the interior of the toroid. The latch wires 144 are connected to a control system or driver 150 which establishes a desired remanence in the gyromagnetic material by applying a current pulse of appropriate amplitude and duration to the latch wires 144.

It has been found that in the preferred embodiment optimum characteristics are achieved by including two inductive irises 130 within the phase shifter waveguide in the vicinity of its end which is toward the system's radiation port 211. This aids in bringing the system's overall response close to the center of a Smith chart as measured by a computer analyzer as discussed hereinafter and thus improves the match.

The direct coupling of the phase shifter 110 to the short horn radiator 210 in accordance with this preferred embodiment of the invention is accomplished by connecting the phase shifter waveguide 12 to the waveguide port 215 of the horn 210 with the gyromagnetic material 146 of the shifter extending beyond the end 114 of the phase shifter waveguide 112 and through the waveguide port 215 into the interior of the short horn radiator 210 as illustrated in FIG. 2. The phase shifter is oriented with the broad walls 116 and 120 of its waveguide adjacent to the broad walls 216 and 220 of the horn, respectively.

The waveguide 112 of phase shifter 110 preferably extends a distance A into the interior 224 of the short horn 210. In the interests of size and weight minimization the distance A is preferably small. A front end 114 of waveguide 112 is formed by the termination of all four walls (116, 118, 120 and 122) of waveguide 112 at substantially the same distance $L_S$ (the effective length of the short horn) behind the front face 212. This allows transformer action to occur in a direction parallel to the broad walls and in a direction parallel to the narrow walls of the short horn, simultaneously. This contrasts with the prior art long horn structure in which the initial transformer action takes place primarily in a direction parallel to the broad walls because of the extension of the broad walls of the phase shifter waveguide into the otherwise empty transition waveguide section 40 and the presence of the transformer sections (18 and 19 in FIG. 1).

The gyromagnetic toroid 146 and the ceramic inserts 142 in applicant's arrangement in FIG. 2 protrude a distance B beyond the end 114 of waveguide 112. The gyromagnetic material 146 and the ceramic material 142 preferably both terminate abruptly. This yields a front face 148 on gyromagnetic toroid 146. Face 148 is preferably substantially planar and parallel to horn face 212. If desired, the edges of the front face 148 of toroid 146 may be chamfered or rounded to reduce the chances of accidental chipping during fabrication and assembly. The ceramic 142 may be flush with, may protrude slightly beyond, or may be slightly recessed from the front face 148 of toroid 146.

The face 148 is positioned a distance C behind the front face 212 of the horn. Thus, $B+C=L_S$, where $L_S$ is the effective length of the short horn which is preferably less than the physical length of the horn for reasons to be discussed hereinafter. Of the dimensions A, B and C, the distance C is the most critical. The distance B is the next most critical and the distance A is non-critical as long as $A \geqq 0$.

The distance B by which the gyromagnetic toroid 146 extends beyond the waveguide 112 is one of the variables which is adjusted in tuning the system to provide optimum operation. A third design variable which is adjusted in arriving at an optimum configuration is the distance C from the face 148 of toroid 146 to the front face 212 of the radiator.

The projection A of the waveguide 112 beyond the horn back wall 214 into the interior 224 of the short horn radiator 210 is not critical because, so long as the end 114 projects into the interior 224 of radiator 210, the ensemble's characteristics are relatively insensitive to the projection distance A. This is believed to be a result of the projecting waveguide creating a virtual back wall on the horn interior by effectively separating, into two separate waveguides, any portion of the horn interior which is further from horn face 212 than waveguide end 114 is. Each of these "effectively separate waveguides" is small enough that it is beyond cutoff at the frequencies utilized in the system. Because of the presence of this virtual back wall, the physical back wall 214 may be omitted or may have large holes in it without adversely affecting system performance. Consequently, the location of the end 114 defines the position of the waveguide port 215 of the horn 210. Waveguide port 215 is the location where a wave propagating in waveguide 112 of shifter 110 begins spreading out into the larger interior of horn 210. The short horn's effective length $L_S$ is the distance from the radiation port 211 in face 212 to the waveguide port 215.

It is preferred that the phase shifter waveguide 112 project beyond the back wall 214 into the interior 224 of the horn because otherwise the characteristics of the phase shifter-radiator ensemble are extremely sensitive to the position of the front end 114 of the waveguide. If the end 114 is flush with the back wall 214, then good characteristics are still obtained. If the end 114 is recessed into the horn back wall 214, then the system's characteristics depend on the exact position of the end 114. Thus, unless the end 114 projects at least slightly into the interior 224 of horn 210, assembly tolerances become extremely critical which is considered undesirable.

It is preferred that the oppositely disposed horn walls be parallel, because if they are not parallel that causes the system's characteristics to be unduly sensitive to the position of the end 114 of phase shifter waveguide 112 even though is protrudes into the interior of the horn.

The relative insensitivity of the system's characteristics to the exact location of the end 114 of phase shifter waveguide 112 renders the overall system useful in arrays designed to have low side lobes (down at least 40 dB from the main beam) because achievable assembly tolerances only slightly affect side lobe level. Naturally, it is also useful in less demanding (higher side lobe level) arrays. Displacement of end 114 of waveguide 112 as a result of fabrication and assembly tolerances is thus prevented from adversely affecting the array sidelobe level.

Preferably the separation E between the broad walls 216 and 220 of the horn is greater than the outside dimension G (broad wall to broad wall) of the phase shifter waveguide 112. This allows easy insertion of the waveguide 112 into the horn 210 and aids in establishing a desired spacing between the gyromagnetic material and the horn broad walls. It is also preferred that the waveguide 112 be centered between the walls of the horn 210. Consequently, in the preferred embodiment the waveguide broad wall 116 does not directly contact the adjacent broad wall 216 of the short horn radiator and waveguide broad wall 120 does not directly contact the adjacent broad wall 220 of the horn. However, broad waveguide wall 116 is electrically shorted to the horn board wall 216 and the waveguide broad wall 120 is electrically shorted to the horn broad wall 220. This is accomplished by a plurality of springs 128 of which one is shown in FIG. 2.

It is preferred that the gyromagnetic toroid not contact the broad walls 216 and 220 of the horn, at least in the preferred embodiment, because this simplifies the optimization of the match between the phase shifter and the propagation medium into which the horn 210 radiates. Thus, gyromagnetic toroid 146 is spaced a distance D from the horn broad wall 216 and centered between broad walls 216 and 220. The distance D is one of the design variables of the system which affects the impedance match between the phase shifter and the external propagation medium. The distance D may be zero if desired, but as indicated is preferably greater than zero.

Matching of the overall system to the external propagation medium is accomplished by adjusting one or more of (1) the spacing between the forward end 148 of the gyromagnetic material 146 and the front 212 of the horn, (2) the distance by which the gyromagnetic material 146 extends beyond the end 114 of the phase shifter waveguide 112, (3) the spacing between the gyromagnetic material and the walls 216 and 220 of the short horn, (4) the dimensions of the radiating horn and (5) the positioning of irises within the phase shifter waveguide. The effective dielectric constant of the loading insert 140 also affects the match and thus is a design variable, although changing it would also change the phase shifter's characteristics.

No closed-form equations are known which can be directly solved to determine or specify dimensions which yield an optimum configuration of a phase shifter, short horn radiator ensemble of this type. Rather, as is now common practice in waveguide art, the ensemble details are selected through the use of computer-aided design. This is done by (a) selecting a set of parameters and determining system performance using computer analysis, then (b) modifying one or more parameters and repeating the computer analysis to determine the performance of that configuration and (c) using the previously obtained results to decide what parameter variation(s) to try next and repeating (b) and (c) until an acceptable performance has been obtained. Consequently, the following presently preferred embodiment will aid those skilled in the art in selecting an initial set of parameters for use in designing an ensemble of this type for use in their system.

This presently preferred embodiment of the phase shifter, short horn radiator ensemble is designed for operation in the 3.1 to 3.5 GHz band. The toroid 146 is a garnet which is 0.55 inch (1.4 cm) high by 0.30 inch (0.76 cm) wide and has a wall thickness of 0.09 inch (0.22 cm). The toroid has a dielectric constant of about 15. The ceramic filler 142 inside the toroid has a dielectric constant of about 50. The drive or latch wires 144 pass down the middle of this ceramic 142. The waveguide 112 is 0.55 inch (1.4 cm) high by 0.75 inch (1.9 cm) wide in internal cross-section with the garnet toroid contacting the two walls which are 0.55 inch apart.

The dimensions of the radiating horn 210 are E=0.78 inch (1.98 cm) and F=2.78 inches (7.06 cm). For an empty waveguide of these dimensions a signal having a frequency of 3.3 GHz has a wavelength of about 4.5 inches (11.43 cm). Thus, the horn is about 0.17 wavelength high by 0.62 wavelength wide at the center frequency of the designed operating band. The physical length (as opposed to the effective length) of the horn is about 0.80 inch (2.03 cm). The horn environmental window 228 is a 0.025 inch (0.06 cm) thick alumina slab. Alumina (dielectric constant about 9.8) is preferred because of its low cost and its thermal conductivity which (1) facilitates cooling when incident radiation heats the system and (2) facilitates heating for ice-up prevention when the array is exposed to a freezing environment. An overall environmental protective layer 330 may also be used. If the same thickness of more costly BeO (dielectric constant about 6.6) were used as the window, then the effective length of the horn would need to be slightly increased to still obtain an optimum match between the phase shifter and the propagation medium.

In this preferred embodiment, the spacing D between the toroid 146 and the broad walls 216 and 220 of the horn 210 is about 0.11 inch (0.28 cm). The distance B by which the front face 148 of the toroid 146 extends beyond the front edge 114 of the phase shifter waveguide 112 is about 0.10 inch (0.25 cm) or about 0.02 wavelength. The distance C by which front face 148 of the toroid 146 is recessed behind the front face 212 of the horn 210 is about 0.45 inch (1.14 cm) or 0.1 wavelength. The optimum performance is obtained with C=0.45 inch, but a deviation of ±0.020 inch is considered acceptable, even though performance will be degraded at the outer limits. Degradation increases more rapidly with greater deviations from the optimum position. The distance B is less critical to performance and thus need not have as tight a tolerance as the distance C, provided that the positioning tolerance on C is independent of the tolerance on B.

If the phase shifter waveguide end 114 were recessed into the rear wall 214 of the horn, then a deviation of as little as 0.005 or 0.01 inch (0.0127 or 0.0254 cm) in the positioning of waveguide end 114 would induce a significant deterioration in performance. Thus, the benefits of having $A \geqq 0$ are significant when the problems of assembling a large array are considered.

The above dimensions yield a horn effective length of B+C=0.1+0.45=0.55 inch (1.4 cm) or 0.122 wavelength which is about $\frac{1}{8}$ wavelength at mid-band. The distance A by which the front end 114 of shifter waveguide 112 protrudes beyond the back wall 214 of the horn is about 0.25 inch (0.635 cm). In each instance, the wavelength conversion is based on the wavelength of a signal with a frequency of 3.3 GHz propagating in an empty waveguide of the horn's cross-sectional dimensions.

To further fine tune the match of the ensemble to the propagation medium into which the signal is to be radiated, two inductive irises 130 are positioned 0.20 inch (0.51 cm) back from the end 114 of the waveguide 112 (one on each side of the toroid). With this horn configuration, the overall length of the phase shifter horn combination is 6.45 inches (16.38 cm) for a system providing the same 0°–500° relative phase shift in 5.6° increments as the prior art long horn system. Thus, this configuration is about 7 inches (17.8 cm) shorter than the prior art long horn system. Greater phase control can be obtained by using a longer phase shifter. In addition to being shorter, a combined phase shifter horn assembly in accordance with this invention will weigh about 40% of that of the prior art system.

The above configuration which is optimized for a 30° scan angle in the H-plane achieves a maximum VSWR of less than 1.2 as measured with an array simulator over the frequency band 3.1 to 3.5 GHz for a scan angle of about 30° in the H-plane. The H-plane is parallel to the broad walls of the horn. For this same frequency band and scan angle a good, prior art, long horn system of the type illustrated in FIG. 1 and discussed in the Campbell et al. article had a VSWR of 1.8. Since the array radiating aperture arrangement including center-to-center spacing of the array elements in that prior art system is the same as in the present simulated system, the comparison of these VSWR values should be an indicator of the overall relative quality of this radiator system as compared to the prior art long horn system. That is, since the various individual short horn radiators of the present invention will experience the same mutual coupling effects which depend on the array periodicity as the prior art system experienced, the variation of VSWR with scan angle should be similar.

In the presently preferred embodiment of this invention, the horn does not need either the thick inductive iris 66 or the two capacitive irises 62 and 64 of the prior art long horn system. However, as mentioned, it does employ two thin inductive irises within the phase shifter waveguide in order to optimize the overall match of the system.

This horn design lends itself readily to numerically controlled (NC) milling for the fabrication of all the horns of an entire array face from a single piece of flat stock or a few large pieces of stock, depending on the array size. The result is an entire array of horns which comprise a single unitary structure. The short physical length of the horn (0.80 inch (2.03 cm)) in the illustrative embodiment makes it relatively inexpensive to fabricate by NC milling. Of particular significance for NC milling is the absence of the thick inductive iris and the two capacitive irises of the prior art long horn system. The presence of such irises would make fabrication by NC milling either impossible or much more expensive. The shortness of the horn also makes the initial thickness (about 1.25 inch (3.175 cm)) of the stock for such an array face handleable. Stock thickness will depend on the size of the array and the structural strength required of the array structure.

NC milling of the array face yields a significant improvement in array strength, uniformity and stability over the prior art techniques of assembling prefabricated horns into an array. This, in turn, aids in making low side lobe arrays feasible.

The illustrative preferred embodiment of this invention involves the coupling of a gyromagnetic waveguide phase shifter to a short horn radiator. However, this technique is of much wider applicability. In particular, it is applicable to the coupling of a waveguide loaded with a body of one dielectric constant to a short horn radiator having a different dielectric constant therein, since in the above described embodiment the gyromagnetic material acts as a dielectric for coupling purposes. It will be understood that the dielectric of the horn which is referred to as having a different dielectric constant is the portion in the vicinity of the waveguide's protruding dielectric. Windows or other components spaced from said protruding dielectric are separate and do not prevent the coupling effect of the protruding dielectric, whether their dielectric constant is the same as, greater than or less than that of the protruding dielectric. Where the horn is larger than the waveguide (the usual case) then the effective dielectric constant of the protruding dielectric should be greater than the effective dielectric constant of the rest of the portion of the horn into which the waveguide dielectric protrudes.

An illustrative preferred embodiment of a gyromagnetic phase shifter, short horn radiator ensemble has been illustrated and described. As is well known in the phased array antenna art, the detailed design of a radiating element in an array involves a number of tradeoffs in order to arrive at a final design which optimizes the overall operational characteristics of the array for its intended use. The presence in the system of this invention of at least five independently adjustable match-affecting parameters allows wide flexibility in the adjustment of system parameters to obtain optimum overall response. Additional waveguide techniques such as irises may be used if desired. Those skilled in the art will be able to modify the preferred embodiment without departing from the scope of the invention as defined by the appended claims.

What is claimed is:

1. A short horn radiator assembly for operation over a predetermined band of operating frequencies, said assembly comprising:

a short horn radiator for radiating electromagnetic radiation into an external propagation medium, said horn radiator having a radiation port, a waveguide port, a pair of oppositely disposed broad walls and a pair of oppositely disposed narrow walls oriented perpendicular to said broad walls, said walls extending longitudinally between said radiation port and said waveguide port, said horn having a length from said waveguide port to said radiation port of less than $\frac{1}{2}$ wavelength at any one of said operating frequencies;

a dielectrically loaded waveguide connected to said waveguide port of said horn, said dielectrically loaded waveguide comprising a rectangular waveguide and a body of dielectric material within said waveguide, said waveguide having a pair of oppositely disposed, parallel broad walls and a pair of oppositely disposed, parallel narrow walls oriented perpendicular to said broad walls, said body of dielectric material extending between said broad walls of said loaded waveguide, said waveguide oriented with its broad walls adjacent the broad walls of said horn, said broad walls of said horn being broader than said broad walls of said waveguide, said waveguide electrically coupled to said horn at said waveguide port and having each of its broad walls electrically shorted to the adjacent broad wall of said horn; and a portion of said body of dielectric material protruding beyond the end of said waveguide, through said waveguide port, into said horn and terminating within said horn, said protruding dielectric having a larger effective dielectric constant than the effective dielectric constant within the rest of the portion of said horn into which said dielectric protrudes.

2. The assembly recited in claim 1 wherein:

said horn has a back wall fixed to and electrically shorted to said longitudinal walls of said horn; and said waveguide protrudes through said back wall toward said radiation port.

3. The assembly recited in claim 1 wherein said waveguide is physically spaced from the walls of said horn.

4. The assembly recited in claim 1 wherein said length of said horn is less than $\frac{1}{4}$ wavelength at any one of said operating frequencies.

5. The assembly recited in claim 4 wherein said length is about $\frac{1}{8}$ wavelength.

6. The assembly recited in claim 1 wherein said broad walls of said horn are parallel.

7. The assembly recited in claim 1 or 6 wherein said narrow walls of said horn are parallel.

8. The assembly recited in claim 1 wherein said portion of said body of dielectric material which protrudes into said horn ends abruptly.

9. The assembly recited in claim 1 or 2 wherein said waveguide further includes:

an iris positioned in said waveguide to change the matching of said waveguide to the combination of said horn and said propagation medium.

10. The assembly recited in claim 9 wherein said iris is inductive.

11. The assembly recited in claim 1 wherein said loaded waveguide is a gyromagnetic phase shifter and said dielectric material includes the gyromagnetic material of said phase shifter.

12. The assembly recited in claim 1 wherein said protruding portion of said dielectric protrudes beyond the ends of all walls of said waveguide.

13. The assembly recited in claim 1 wherein said protruding portion of said dielectric is spaced from said walls of said horn.

* * * * *